United States Patent [19]

Baum

[11] 4,151,748

[45] May 1, 1979

[54] TWO COLOR THERMALLY SENSITIVE RECORD MATERIAL SYSTEM

[75] Inventor: Henry H. Baum, Appleton, Wis.

[73] Assignee: NCR Corporation, Dayton, Ohio

[21] Appl. No.: 861,046

[22] Filed: Dec. 15, 1977

[51] Int. Cl.[2] ..... B41M 5/18

[52] U.S. Cl. ..... 73/356; 96/90 R; 96/90 PC; 101/469; 101/470; 101/473; 106/14.5; 116/207; 250/317; 427/146; 427/148; 427/150; 427/151; 252/408

[58] Field of Search ..... 252/408; 101/469, 470, 101/473; 73/356; 116/114.5, 114 AM, 114 V; 427/146, 148, 150, 151; 96/90 R, 90 PC; 250/317; 106/14.5

[56] References Cited

U.S. PATENT DOCUMENTS

| | | | |
|---|---|---|---|
| 1,844,199 | 2/1932 | Bicknell et al. | 116/114 V |
| 1,917,370 | 7/1933 | Hickman | 101/469 |
| 1,924,793 | 8/1933 | Laske | 116/114 V |
| 3,121,650 | 2/1964 | Meissner | 116/114 V |
| 3,293,055 | 12/1966 | Baum | 106/171 |
| 3,451,338 | 6/1969 | Baum | 101/469 |
| 3,471,422 | 10/1969 | Edlein et al. | 73/356 |
| 3,887,808 | 6/1975 | van den Houte et al. | 96/90 PC |
| 3,964,911 | 6/1976 | Rodillard | 96/90 PC |
| 4,010,033 | 3/1977 | Metzger | 96/90 PC |

FOREIGN PATENT DOCUMENTS

| | | | |
|---|---|---|---|
| 47-13427 | 4/1972 | Japan | 96/90 PC |
| 49-37917 | 1/1974 | Japan | 101/470 |
| 49-122345 | 11/1974 | Japan | 101/470 |
| 52-11231 | 3/1977 | Japan | 101/470 |

*Primary Examiner*—Benjamin R. Padgett
*Assistant Examiner*—T. S. Gron
*Attorney, Agent, or Firm*—E. Frank McKinney; Paul S. Phillips, Jr.

[57] ABSTRACT

A thermally sensitive record medium is disclosed. Data is generated on the record medium in response to an application of heat. The record medium is capable of generating data images in more than one color by exposing the medium to more than one temperature level in areas to be imaged. Overlap or interference between two colors is avoided by utilizing at least one color-forming system which requires a thermal decomposition of one system component before it can be reacted to yield color.

The record material is made by coating individual layers, each containing a color-forming system or preferably by coating a single layer including all of the color-forming systems.

15 Claims, No Drawings

TWO COLOR THERMALLY SENSITIVE RECORD MATERIAL SYSTEM

BACKGROUND OF THE INVENTION

Field of the Invention

This invention relates to record media on which data are developed in response to an application of heat. It more particularly relates to such record media in the form of sheets coated by color-forming systems wherein a sheet includes more than one color-forming system. Specifically, it also pertains to such a coated sheet on which images can be generated in more than one color by subjecting areas of the sheet to different, particular, temperature levels to obtain different, particular, colors.

This invention particularly concerns a temperature sensitive record material of more than one color response wherein overlap and interference between the colors is minimized by utilizing, as at least one of the color-forming systems, a system which remains colorless until a decomposition temperature is reached for one of the components, only then enabling the component to take part in a coloration reaction. This invention, relating as it does to record sheets using such color-forming systems which are triggered by heat decomposition, pertains to improved thermal record media having a relatively sharply-defined temperature above and below which images of distinctly different color are generated.

This invention pertains to such record media including one or more coating layers of color-forming system materials.

Description of the Prior Art — U.S. Pat. No. 3,293,055 issued Dec. 20, 1966 on an application of the inventor herein, discloses a thermo-colorable record copy sheet wherein minute particles of the components of a color-forming system are dispersed into a polymeric binder and coated as a layer. The copy sheet is disclosed to yield a color when areas to be imaged are heated to a temperature sufficient to melt one or both of the components. The only disclosed mechanism for color formation is fusion of the components. The disclosed record sheets generate a single color. The color-forming components are benzoindolino-spiropyran derivatives and metallic salts of organic acids.

U.S. Pat. No. 3,451,338 issued June 24, 1969 on an application of the inventor herein, discloses a temperature responsive and colorable record material which is similar to previously discussed U.S. Pat. No. 3,293,055. Again, color formation is accomplished by simple fusion. The disclosed sheets generate a single color. The color-forming components are benzoindolinospiropyran derivatives and phenolic compounds.

Japanese Application No. Sho 47-86269, filed Aug. 30, 1972, and disclosed Apr. 24, 1974 as Japanese Disclosure No. Sho 49-43645 to Mitsubishi Paper Mills, Ltd., discloses a two-color thermal paper. The disclosed thermal paper includes both color-forming systems in a single coating layer. The chromogenic components are fluoran compounds and the coreactant component is a phenolic compound. For any given two-color system the phenolic coreactant and both of the fluorans are dispersed in the single coated layer and the developed color of any thermal image depends entirely on the melting point of the fluoran compounds. The colors are each generated by a fluoran and the mechanism of color formation is always fusion of the component materials.

Any material impurities or mutual solution of the fluoran melts tend to cause an overlap in component melting points and an interference of the generation of one color with development of the other.

Japanese Disclosure No. Sho 50-6349 disclosed Jan. 23, 1975 as Application No. Sho 48-53703 filed May 16, 1973 in the name of Mitsubishi Paper Mills, Ltd., also discloses a two-color thermal paper. This disclosure attempts to solve the problem of overlapping color formation in two-color record sheets by incorporating a decolorizing material in the coating composition. Two chromogenic materials, a phenolic coreactant, and a decolorizing agent (such as a guanidine) are homogeneously dispersed in a polymeric binder material, all in a single layer. As the sheet is heated, both chromogenic materials form color to yield the initial color image. When the temperature is increased still more, the decolorizing agent melts and decolors only one of the chromogenic materials. To the extent that the effects of the decolorizing agent overlap or the decolorizing agent interferes with both of the chromogenic materials, the difficulty of a broad temperature range requirement for adequate color differentiation persists.

Japanese Disclosure No. Sho 49-96738 disclosed Sept. 12, 1974 as Application No. Sho 48-7003 filed Jan. 17, 1973 in the name of Mitsubishi Paper Mills, Ltd., also discloses a two-color thermal paper. This thermal paper also includes a single layer embodiment. The single layer includes an acid-reacting chromogen, a base-reacting chromogen, an acid coreactant, and a base coreactant, all homogeneously dispersed in a polymeric binder material. Color development depends upon fusion of at least the coreactant materials. The pairs of selected coreactants have different melting points. The first to melt colors the appropriate chromogen and the second to melt neutralizes the first coreactant, decolors the first chromogen, and colors the second chromogen. All components of the disclosed sheet are present in the sheet in a reactive condition. There is no preliminary reaction or decomposition required to prevent premature coloration.

SUMMARY OF THE INVENTION

In the field of thermal-responsive recording materials, there is considerable demand for an acceptable product which will yield more than one color of printed data. Several products have been offered, but most suffer from a problem of developed color overlap within a relatively broad temperature range. When each of two colors are developed in broad and overlapping temperature ranges, the actual image color is only relatively gradually changed as the temperature is changed.

It is an object of this invention to provide a thermal-responsive recording material having more than one color for data representation. It is further an object of this invention to provide such a recording material having several relatively narrow temperature ranges in which images develop in different colors.

It is a specific object of this invention to provide a two-color thermal record material having color-forming systems effective at different temperatures wherein color formation at the higher temperature first requires decomposition of a component to generate a color reactant.

It is also an object of this invention to provide such a thermal record material having only a single coating layer including more than one color-forming system. It is also an object of this invention to provide a thermal record material having more than one color-forming system, at least one of which includes a component requiring decomposition prior to color generation, and each of which is included in a separate coating layer.

The record material of this invention provides additional color development within a relatively narrow temperature range. To give a specific example of such record material having two colors: (i) a low temperature color-forming system is provided which relies solely upon melting or subliming (vaporizing of solid particles) one or more of the components to achieve reactive, color-producing, contact and (ii) a higher temperature color-forming system is provided which ultimately relies upon melting or vaporizing one or more of the components but which first must generate one of the reactive components by decomposition of a material in the color-forming system. The low and higher temperature color-forming systems are coated onto a substrate which, when heated, yields an image in the configuration of the area heated and of a color corresponding to the temperature reached. In heating the coated substrate, the color of the low temperature color-forming system develops at the color advent temperature for that system. As the temperature is increased further — and this is most important to understanding of the present invention — no additional color is developed until the temperature is reached for decomposition of that material in the high temperature color-forming system which must be decomposed to enter a color-forming reaction. When that decomposition temperature is reached, the second color is generated over the first color. As a rule, the first color has the appearance of a relatively pure hue such as red, blue, green or the like and the second color has a more or less neutral hue resulting from combination of the hues from the first and second color-forming systems. Generation of color in the higher temperature color-forming system does not decolor or erase the first-developed color. The two colors are combined to provide the darkest images and the most effective use of color-forming materials.

The matter of the component decomposition is very important to this invention in permitting combination of color-forming systems which develop individually at clearly-defined temperatures rather than together and gradually over a broad temperature range. Systems of the prior art which have relied on fusion (melting) or vaporization (including sublimation of solid particles) of materials to generate colors generate a wide gradation of colors extending from the hue of the first, through all combinations of the first and the second, to the hue of the second. The melt formed by components of a first color-forming system tends to cause solution of components of a second color-forming system by lowering the component melting points. The sublimation of one component of a first color-forming system causes particular problems when this component also reacts with a component of the second color-forming system. When, as in the present invention, a component decomposition is required before color reaction can occur, a melt or sublimation of one or more of the first system components has no effect.

The record material includes a substrate or support material which is generally in sheet form. For purposes of describing this invention, sheets also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials and it can be a film including, for example, cellophane and synthetic polymeric sheets cast, extruded, or otherwise formed. The kernel of this invention resides in the combination of color-forming systems coating the substrate; and the kind or type of substrate material is not critical.

The components of the color-forming systems are in a contiguous relationship, substantially homogeneously distributed throughout the coated layer material deposited on the substrate. In manufacturing the record material, a coating composition is prepared which includes a fine dispersion of the components of color-forming systems, polymeric binder material, and surface active, or other, additives in an aqueous coating medium. The color-forming system components should be substantially water insoluble and ground to an individual average particle size of about 5 microns. The polymeric binder material should be substantially water soluble although latexes are also eligible in some instances. Preferred water soluble binders include poly (vinyl alcohol), hydroxy ethylcellulose, methylcellulose, starch, modified starches, gelatin and the like. Eligible latex materials include polyacrylates, polyvinylacetates, polystyrene, and the like. The polymeric binder is used to protect the coated materials from brushing and handling forces occasioned by storage and use of the thermal sheets. Binder should be present in an amount to afford such protection and in an amount less than will interfere with achieving reactive contact between color-forming reactive materials. An effective sheet is made with about 1 to about 30 weight percent binder in the dried coating composition. The binder is preferably present as 5 to 30 weight percent of the dried coating.

Examples of eligible additives are surface active agents such as defoamers including sodium lauryl sulfonate, octanol, acetylenic glycols, silicones, fatty acid esters, and the like. Also, if desired or required for a particular purpose, waxes, clays, fillers, colorants, obscurants, and the like can be added to the coating composition in amounts which do not adversely affect the thermal response.

Coating weights are not of critical importance although, in sheets of more than a single layer, care must be exercised to utilize coating amounts sufficient to yield two distinctive colors and, at the same time, moderate to permit proper heat transfer from one layer to the next. As a general rule, the amounts of color-forming systems in the coating layers should be approximately commensurate — the weight of one not more than about ten times the weight of another, for example. Coating weights for such layers can effectively be about 1.5 to about 8 and preferably about 3 to about 6 grams per square meter. As a practical matter, the lower limit for coating each layer is the amount required to provide the desired color response. As a general rule, material in layers beneath the surface layer must be present in increased amounts so as to overcome masking effects of the layers above.

Sheets having only a single layer of thermally sensitive coating are preferred over sheets having more than one layer. The coating weight for such sheets is not of critical importance so long as the proper amounts of each color-forming system are present to yield adequate color development and color differentiation at the marking temperature levels.

Benefits of the invention are realized to the extent that some of each of more than one eligible color-forming system is combined into a single coating layer. If each color is developed at its proper developing temperature, and the materials are present in an amount adequate to discern the color, when developed, then the sheet demonstrates the invention. Generally, the coating weight of all color-forming systems in a single coated layer will be greater than about 2 and not in excess of about 8 grams per square meter. The weight ratio of the materials of one color-forming system to another color-forming system is preferably between about 1 and about 10 for sheets having a single coated layer. In addition, the weight ratio of chromogenic material to coreactant for any given color-forming system is about 1 to about 12, preferably about 1 to about 6.

The practical minimum amount of color-forming materials is controlled by image darkness requirements and the practical maximum amount is controlled by economic considerations and desired handling characteristics of the coated sheets.

Sheets coated with a single layer exhibit advantages over other sheets by providing a sharper and more distinct thermal image in the generally thinner-coated materials. In a sheet of a single coated layer, both of the color-forming systems are in the top layer and all of the components are intimately combined. Moreover, sheets of a single coated layer exhibit marked economic advantage over sheets requiring more than one layer, simply in decreased manufacturing costs and decreased materials costs. The single layer coated sheet of this invention exhibits more desirable handling characteristics than sheets requiring more than one coated layer.

Of the two types of color-forming systems, one relies on fusion (melting) or sublimation (vaporization of solid particles) of one or more components and the other relies on decomposition of one component prior to color reaction. The fusion or sublimation system generally utilizes acidic materials, such as phenolic compounds, and basic chromogenic materials which react with acidic materials. Such basic compounds include materials with a lactone ring, for example, phthalides or fluorans. Examples of eligible acid material include the compounds listed in U.S. Pat. No. 3,451,338 as phenolic reactive materials, particularly the monophenols and diphenols. The list is exemplary only and not intended to be exhaustive — 4-t-butyl phenol, 4-phenyl phenol, 4-hydroxydiphenyl oxide, $\alpha$-naphthol, $\beta$-naphthol, methyl-4-hydroxybenzoate, 4-hydroxyacetophenone, 4-t-octylcatechol, 2,2'-dihydroxydiphenyl, 2,2'-methylene bis (4-chlorophenol), 2,2'-methylene bis (4-methyl-6-t-butylphenol), 4,4'-isopropylidenediphenol, 4,4'-isopropylidene bis (2-chlorophenol), 4,4'-isopropylidene bis (2,6-dibromophenol), 4,4'-isopropylidene bis (2,6-dichlorophenol), 4,4'-isopropylidene bis (2-methylphenol), 4,4'-isopropylidene bis (2,6-dimethylphenol), 4,4'-isopropylidene bis (2-t-butylphenol), 4,4'-sec.-butylidene bis (2-methylphenol), 4,4'-cyclohexylidene phenol, 4,4'-cyclohexylidene bis (2-methylphenol), 2,2'-thio bis (4,6-dichlorophenol), 4,4'-thiodiphenol, and the like. Although not preferred, other acid compounds of other kinds and types are eligible. Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, halloysite, and the like. Some of the polymers and minerals do not melt but undergo color reaction on fusion of the chromogen.

The eligible basic chromogenic compounds, such as the phthalide and fluoran compounds, for use in the fusion color-forming system are well known color-forming compounds. Examples of the compounds include Crystal Violet Lactone (3,3-bis(4-dimethylaminophenyl)-6-dimethylamino phthalide (U.S. Pat. No. Re 23,024); phenyl-, indol-, pyrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390). Other specifically eligible chromogens, not limiting the invention in any way, are: 6'-diethylamino-1', 2'-benzofluoran; 3,3-bis(1-ethyl-2-methyl-3-yl) phthalide; 6'-diethylamino-2'-anilinofluoran; 6'-diethylamino-2'-benzylaminofluoran; 6'-diethylamino-2'-butoxyfluoran; and 6'-diethylamino-2'-bromo-3'-methylfluoran.

The decomposition color-forming system is of two types — determined by the chromogenic or so-called color-forming material. One type of decomposing system utilizes an organic substituted thioamide to generate hydrogen sulfide when heated to decomposition temperature. Examples of eligible thioamides, along with the temperature of decomposition, are presented in the table, below.

| | Thioamide | Decomposition Temp. (° C.) |
|---|---|---|
| 1. | thioazelamide | 138–141 |
| 2. | thioadipamide | 187–190 |
| 3. | diphenylthioacetamide | 151–153 |
| 4. | biphenylthioacetamide | 170–174 |
| 5. | p-chloro-phenylthioacetamide | 126–129 |
| 6. | benzoylthioacetamide | 128–130 |
| 7. | tetramethylenedithiopropionamide | 119–121 |
| 8. | phenoxythiopropionamide | 91– 93 |

A general formula for eligible thioamides is given by R-CS-$NH_2$ wherein R can be alkyl, aryl, aralkyl, alkyloxy, aryloxy, and the like.

The second type of decomposing system utilizes a reaction-blocked benzoindolinospiropyran — so-called "dicondensed" benzoindolinospiropyran compounds. These dicondensed compounds split into individual moieties at relatively low temperatures and one of the moieties is a chromogenic material. Examples of eligible dicondensed spiropyran compounds, along with the temperature of decomposition, are presented in the table, below:

| | Spiropyran | Decomposition Temp. (° C.) |
|---|---|---|
| 1. | 4'-(1'',3'',3''-trimethylindolenyl)-6'-chloro-8'-ethoxy-1,3,3-trimethyl-benzoindolino-spiropyran | 205–207 |
| 2. | 4'-(1'',3'',3''-trimethylindolenyl)-6'-chloro-8'-methoxy-1,3,3-trimethyl benzoindolino-spiropyran | 204–206 |
| 3. | 4'-(1'',3'',3''-trimethylindolenyl)-8'-methoxy-1,3,3,trimethyl-benzoindolino-spiropyran | 208–210 |
| 4. | 4'-(1'',3'',3''-trimethylindolenyl)-8'-ethoxy-1,2,2-trimethyl benzoindolino-spiropyran | 200–202 |

As a general rule, the blocking moiety is an indolenyl radical joined to the 4′ position of a basic benzo-indolinospiropyran molecule having the structure (with additional substitution in at least the 8′ position):

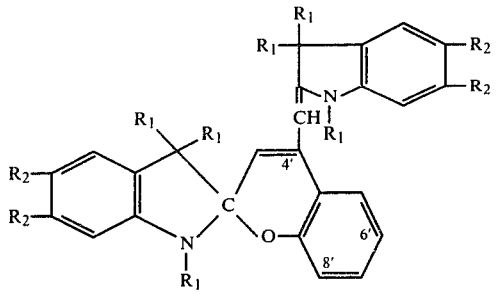

wherein $R_1$ is a lower alkyl or phenyl group. Most commonly, $R_1$ is methyl, $R_2$ can be hydrogen, alkyl, alkoxy, halogen and the like. Specific examples of the blocked dicondensed benzo-indolinospiropyrans represented by this formula have the following substituents ($R_1$ is methyl and $R_2$ is hydrogen unless some other group is indicated by position number):

8′-methoxy
8′-ethoxy
1-phenyl-8′-methoxy
5-chloro-8′-methoxy
6′-chloro-8′-methoxy
5,6′-chloro-8′-methoxy
4,7,8′-trimethoxy Additional examples of eligible benzo-indolinospiropyran compounds which can be blocked at the 4′ position by an indolenyl radical are found in previously-cited U.S. Pat. Nos. 3,293,055 and 3,451,338.

The preparation of dicondensed benzo-indolinospiropyran chromogens is taught in Techniques of Chemistry, Vol. III "Photochromism" Chapter III pages 254–257, Wiley-Interscience 1971.

The dicondensed spiropyran compounds, once decomposed, are the same as the spiropyran compounds of U.S. Pat. Nos. 3,293,055 (metallic salts) and 3,451,338 (phenolic compounds) and react with the coreactants described therein to yield color. Moreover, the hydrogen sulfide generated from decomposition of the thioamide compounds also reacts with several of the coreactants of U.S. Pat. No. 3,293,055. For purposes of describing metallic coreactants eligible for use in this invention cations and anions will first be considered individually. Anions are important only insofar as they provide a desired melting point or cation availability to the compound, as a whole. Generally eligible anions are resinate, naphthenate, stearate, oleate, acetylacetonate, acetate, undecylenate, ricinolate, and the like.

The eligible cations are generally at least divalent and are responsible for forming the color product of the decomposing color-forming system. Generally eligible cations are nickel, iron, lead, mercury, copper, cobalt, manganese, zinc, aluminum, magnesium, calcium, strontium, and the like. For use with the thioamides, the first six cations listed above can be used, forming a dark colored sulfide.

The temperatures at which the colors are generated, in practice of this invention, are important only in that all of the color-forming temperatures must be within some reasonable range of intended operation and the individual color-forming temperatures for systems in a given thermal sheet must exhibit some reasonable separation. A reasonable range of intended operation is taken to be from about 60 to about 200 degrees centigrade. A reasonable separation of color-forming temperatures is any separation greater than about 20 to about 30 centigrade degrees. Of course, even if the separation were less, the benefit of the present invention would be enjoyed to the extent that the fusion or sublimation coloration can be caused to occur before the coloration brought about by decomposition. The fusion or sublimation color-forming system is selected so as to produce color at a temperature lower than the temperature at which the decomposing color-forming systems react. More than one decomposing system can be used providing only that the individual systems do not interfere with each other or produce the same color.

DESCRIPTION OF PREFERRED EMBODIMENTS

In the following comparative example and the numbered examples illustrating the present invention all parts are parts by weight, all temperatures and degrees are centigrade, and all measurements are in the metric system, unless otherwise stated.

COMPARATIVE EXAMPLE

This example demonstrates overlap and interference in the development of two color-forming systems when each system colors by means of fusion alone.

In this comparative example and in all following examples illustrating the present invention a dispersion of a particular system component is prepared by milling the component in an aqueous solution of the binder until a predetermined particle size is achieved. For convenience the binder material will always be poly (vinyl alcohol) of a film forming, water soluble, grade. Use of poly (vinyl alcohol) in these examples must not be taken to mean that others of the disclosed binders are not eligible. The milling is accomplished in a ball mill or using an attritor and the desired particle size will be taken as about three microns unless otherwise specified. Of course, in the case of a liquid system component the milling is conducted in a high speed blender.

The proportions of the coating compositions are as follows:

| Material | Parts |
|---|---|
| color system component | 10–30 |
| binder material | 1–5 |
| surface active material | 0–0.1 |
| water | 65–89 |

In accordance with the description, individual coating composition dispersions are prepared with: (i) 2′-methoxy-6′-diethylaminofluoran; (ii) 2′-anilino-6′-diethylaminofluoran; and (iii) 4,4′-isopropylidenephenol.

Four parts of (iii) are mixed with one part of (i) and coated onto a paper sheet at a weight of about 5 grams per square meter (dry). This coating, when dried and heated to about 100 degrees yields a red color.

Four parts of (iii) are mixed with one part of (ii) and coated onto a paper at about 5 grams per square meter (dry). This coating, when dried, yields no color below about 110 degrees and turns green at about 120 degrees and above.

The two coating compositions made above are coated onto a single sheet in two layers. Additional samples are then combined and coated onto another sheet as a single layer. The two layer sheet turns blackish-red at about 100 degrees and the blackish-red color gradually darkens to black as the temperature is raised to about 120 degrees. The single layer sheet turns black at about 100 degrees. In the case of the single layer black development at low temperature, both chromogenic materials colored together because the low temperature melt of one chromogenic material serves as a cosolvent for the other.

When the two coating compositions are coated onto a sheet as individual layers separated by a clear coating of insulating polymeric material, a red color develops at about 100 degrees and remains fairly pure in hue until the temperature is above about 110 degrees. The combination of red and green produces a black color above about 120 degrees. The insulating third layer in such a coated sheet provides the desirable, sharp-color-charge character of the present invention but requires a cumbersome and expensive three layer construction compared to the one or two layers herein.

The following Examples illustrate two-color thermally responsive record material systems of this invention:

EXAMPLE I

Coating composition dispersions are prepared as follows:

| | | | |
|---|---|---|---|
| A | Crystal violet lactone | 17 | parts |
| | binder | 3 | |
| | water | 80 | |
| B | 4,4'-isopropylidenediphenol | 22.5 | parts |
| | binder | 2.5 | |
| | water | 75 | |
| C | thioadipamide | 22.5 | parts |
| | binder | 2.5 | |
| | water | 75 | |
| D | nickel acetonylacetonate | 22.5 | parts |
| | binder | 2.5 | |
| | water | 75 | |
| E | nickel naphthenate | 27 | parts |
| | binder | 3 | |
| | water | 70 | |

The dispersions are mixed as follows:

| | |
|---|---|
| A | 16 parts |
| B | 43 |
| C | 35 |
| D | 26 |
| E | 83 |

and sheets are coated with the mixture at a weight of about 4.5 to 6.0 grams per square meter (dry) and dried. It is recognized that the reactive components of A and B form one color and the components of D and E react with hydrogen sulfide from C to form another color. The sheet, heated to about 120 degrees, exhibits a bright blue color. The bright blue remains pure to about 140 degrees and the color abruptly changes to black at about 149 degrees.

When the crystal violet lactone in A is replaced by 6'-diethylamino-1',2'-benzofluoran or 3,3-bis (1-ethyl-2-methyl-3-yl) phthalide (indolyl red), the color developed at 120 degrees is red.

When the crystal violet lactone in A is replaced by 6'-diethylamino-2'-benzylamino fluoran, the color developed at 120 degrees is green.

Separate coated layers of A and B and of C, D and E also produce a thermal sheet having the desired color developing response.

EXAMPLE II

Coating composition dispersions are prepared as follows:

| | | | |
|---|---|---|---|
| A | 2'-butoxy-6'-diethylamino fluoran | 17 | parts |
| | binder | 3 | |
| | water | 80 | |
| B | 4'-(1'',3'',3''-trimethyl-indolenyl)-6'-chloro-8'-ethoxy-1,3,3-trimethyl benzoindolinospiropyran | 17 | parts |
| | binder | 3 | |
| | water | 80 | |
| C | 4,4'-isopropylidene diphenol | 17 | parts |
| | binder | 3 | |
| | water | 80 | |

The dispersions are mixed as follows:

| | |
|---|---|
| A | 10 parts |
| B | 33 |
| C | 98 |

and sheets are coated as in the previous example. Both the chromogenic material of A, and the spiropyran resulting from decomposition of the component in B, react with the phenolic component of C. The sheet, heated to about 110 degrees, exhibits red color. The red remains fairly pure to about 140 degrees and turns brownish-black at about 150 degrees.

EXAMPLE III

Coating composition dispersions are prepared as follows:

| | | | |
|---|---|---|---|
| A | 4'-(1'',3'',3''-trimethyl-indolenyl)-6'-chloro-8'-methoxy-1,3,3-trimethyl benzoindolinospiropyran | 13 | parts |
| | 2'-bromo-3'-methyl-6'-diethylamino-fluoran | 2 | |
| | 3,3-bis(1-ethyl-2-methyl-3-yl)phthalide | 2 | |
| | binder | 3 | |
| | water | 80 | |
| B | 4,4'-isopropylidene diphenol | 9 | parts |
| | ACRAWAX-C* | 8 | |
| | binder | 3 | |
| | water | 80 | |

*Reaction product of hydrogenated caster oil and ethanolamine insoluble in boiling water, melting point of 140 to 143 degrees, flash point of .285 degrees (open cup), specific gravity of 0.97 at 25 degrees, available as fine powder from Glycol Chemicals, Inc., N.Y., N.Y.

The dispersions are mixed as follows:

| | |
|---|---|
| A | 45 parts |
| B | 102 parts |

and sheets are coated as in the previous examples. Both the fluoran and the phthalide of dispersion A and the spiropyran resulting from the decomposition of the indolenyl-blocked spiropyran of dispersion A react with the diphenol of dispersion B. The sheet, heated to 110 degrees exhibits red color, remains fairly pure to about 140 degrees and turns black above about 150 degrees.

While particular embodiments of the present invention have been described, many other possible variations and modifications within the spirit and scope of the invention are intended to be included within the scope of the appended claims.

What is claimed is:

1. A multi-color thermally responsive record material comprising a support sheet bearing a first thermally-sensitive color-forming composition comprising particles of a chromogenic material and a coreactant material in contiguous relationship whereby the melting or sublimation of either material produces a first change in color by reaction between the two, and a second thermally-sensitive color-forming composition comprising particles of a thermally decomposable material and a coreactant material in contiguous relationship, whereby decomposition of the thermally decomposable material forms a chromogenic material which produces a different change in color by reaction with the coreactant material, said decomposition occurring at a higher temperature than said melting or sublimation, said first and second compositions being either in separate contiguous superposed layers or in a single layer on the support sheet.

2. The record material of claim 1 in which the first and second compositions are in separate contiguous superposed layers on the support sheet.

3. The record material of claim 1 in which a binder and the first and second compositions form a single layer on the support sheet.

4. The record material of claim 3 in which the chromogenic material of the first composition is selected from a lactone and a fluoran and the coreactant of the first composition is a phenolic compound.

5. The record material of claim 4 in which the thermally decomposable material is selected from the group consisting of organic substituted thioamides and dicondensed benzoindolinospiropyrans.

6. The record material of claim 5 in which the thermally decomposable material is a thioamide of the general formula

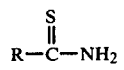

in which R is selected from alkyl, aryl, aralkyl, alkyloxy and aryloxy and the coreactant is a divalent metal compound in which the metal is selected from nickel, iron, lead mercury, copper and cobalt.

7. The record material of claim 5 in which the thermally decomposable material is a reaction-blocked benzoindolinospiropyran and the coreactant is selected from phenolic compounds and divalent metal compounds.

8. The record material of claim 7 in which the benzoindolinospiropyran is substituted in the 4′ position with an indolenyl radical and in the 8′ position with an alkoxy radical.

9. The record material of claim 8 in which the coreactant is a phenolic compound.

10. The record material of claim 9 in which the phenolic compound is selected from monophenols and diphenols.

11. The record material of claim 1 in which the first composition comprises 3,3-bis(1-ethyl-2-methyl-3-yl)phthalide, 2′-bromo-3′-methyl-6′-diethylaminofluoran and 4,4′-isopropylidenediphenol; and the second composition comprises 4′-(1″,3″,3″-trimethylindolenyl)-6′-chloro-8′-alkoxy-1,3,3-trimethyl benzoindolinospiropyran in which the alkoxy is selected from methoxy and ethoxy, and 4,4′-isopropylidenediphenol.

12. The record material of claim 11 in which the alkoxy is ethoxy.

13. The record material of claim 1 in which the first composition comprises 2′-butoxy-6′-diethylaminofluoran and 4,4′-isopropylidenediphenol; and the second composition comprises 4′-(1″,3″,3″-trimethylindolenyl)-6′-chloro-8′-ethoxy-1,3,3-trimethyl benzoindolinospiropyran and 4,4′-isopropylidenediphenol.

14. The record material of claim 1 in which the first composition comprises 3,3-bis(1-ethyl-2-methyl-3-yl) phthalide and 4,4′-thiodiphenol; and the second composition comprises 4′-(1″,3″,3″-trimethyl-indolenyl)-6′-chloro-8′-methoxy-1,3,3-trimethyl benzoindolinospiropyran and 4,4′-thiodiphenol.

15. The record material of claim 1 in which the first composition comprises 3,3-bis(4-dimethylaminophenyl)-6-dimethylamino phthalide and 4,4′-isopropylidenediphenol; and the second composition comprises thioadipamide and nickel acetonylacetonate.

* * * * *